US005965973A

United States Patent [19]

Yang et al.

[11] Patent Number: 5,965,973

[45] Date of Patent: Oct. 12, 1999

[54] ELECTRON GUN FOR COLOR CATHODE RAY TUBE

[75] Inventors: Hak-cheol Yang; Hun-chang Kim, both of Suwon; Neung-yong Yoon, Seoul, all of Rep. of Korea

[73] Assignee: Samsung Display Devices Co., Ltd., Kyungki-Do, Rep. of Korea

[21] Appl. No.: 08/947,626

[22] Filed: Oct. 9, 1997

Related U.S. Application Data

[63] Continuation-in-part of application No. 08/550,936, Oct. 31, 1995, abandoned.

[30] Foreign Application Priority Data

Oct. 31, 1994 [KR] Rep. of Korea ..... 94-28397

[51] Int. Cl.[6] ..... H01J 29/51

[52] U.S. Cl. ..... 313/414; 313/412; 313/428; 313/432; 313/446; 315/15

[58] Field of Search ..... 313/412, 413, 313/414, 428, 432, 446, 449; 315/15, 382

[56] References Cited

U.S. PATENT DOCUMENTS 5,113,112 5/1992 Shimoma et al. .

5,206,561 4/1993 Oh .

5,262,702 11/1993 Shimoma et al. .

*Primary Examiner*—Ashok Patel

*Attorney, Agent, or Firm*—Leydig, Voit & Mayer, Ltd.

[57] ABSTRACT

An electron gun for a color cathode ray tube includes a triode having a cathode, a control electrode, and a screen electrode for producing electron beams; first, second, and third focus electrodes; and a final accelerating electrode sequentially disposed from the screen electrode. A first constant voltage is applied to the screen electrode and the second focus electrode, a second constant voltage higher than the first constant voltage is applied to the first focus electrode and the third focus electrode, and an anode voltage higher than the second constant voltage is applied to the final accelerating electrode, so that electron beams cross from the triode cross between a main lens formed by the third focus electrode and the final accelerating electrode, and an auxiliary lens formed by the first, second, and third focus electrodes. The electron gun produces uniform size electron beam spots over a fluorescent film of a cathode ray tube with reduced spherical aberration.

11 Claims, 4 Drawing Sheets

ELECTRON GUN FOR COLOR CATHODE RAY TUBE

This disclosure is a continuation-in-part of U.S. patent application Ser. No. 08/550,936, filed Oct. 31, 1995 now abandoned.

BACKGROUND OF THE INVENTION

The present invention relates to an electron gun for a color cathode ray tube (CRT) and, more particularly, to an electron gun for a color CRT producing reduced spherical aberration of electron beams illuminating a screen of the CRT.

Conventionally, an electron gun for a color CRT includes a triode, a plurality of focus electrodes sequentially disposed adjacent to the triode, having electron beam passing holes, and forming an auxiliary lens, and a final accelerating electrode disposed adjacent to the focus electrodes and forming a main lens. Voltages are applied to the triode and the respective electrodes of the conventional color CRT to form a unipotential electron lens and a bipotential electron lens. In order to reduce the spherical aberration of the electron lenses formed between the respective electrodes, reduction of the diameter of the electron beams has been conventionally used.

In order to reduce the diameter of electron beams, as shown in FIG. 1, it has been proposed to enlarge the electron lenses by forming large electron beam passing holes within the neck section of the color CRT, or to enlarge effective electron beam passing holes in each electrode into a single, large electron beam passing hole through which all of three electron beams pass.

The former method requires increased deflection power for a deflection yoke, increasing the power consumption of the CRT. If the diameter of the neck section is reduced to reduce the deflection power needed, the diameters of the electron beam passing holes of the electrodes become smaller. Therefore, as shown in FIG. 2, the electron lens L formed by the electrodes with the reduced area electron beam passing holes has increased spherical aberration. The difference between the focal lengths of an electron beam 1 passing through the center of the electron lens L and an electron beam 2 passing through the periphery of the lens becomes large, thereby enlarging the area of an electron beam spot 3 landing on a fluorescent film of a screen.

The latter method is limited in enlarging the electron beam passing hole because of structural considerations.

SUMMARY OF THE INVENTION

To solve the problems of the prior art, it is an object of the present invention to provide an electron gun for a color CRT that can form small and uniform electron beam spots throughout the entire fluorescent layer on a CRT screen by reducing spherical aberration components of the electron lenses formed by the respective electrodes of the electron gun.

To accomplish the above object, there is provided an electron gun for a color cathode ray tube comprising: a triode including a cathode, a control electrode, and a screen electrode for producing electron beams; and first, second, and third focus electrodes and a final accelerating electrode sequentially disposed from the screen electrode, wherein a first constant voltage is applied to the screen electrode and the second focus electrode, a second constant voltage higher than the first constant voltage is applied to the first focus electrode and the third focus electrode, and an anode voltage higher than the second constant voltage is applied to the final accelerating electrode, so each electron beam from the triode crosses between a main lens formed by the third focus electrode and the final accelerating electrode, and an auxiliary lens formed by the first, second, and third focus electrodes.

To accomplish the above object, there is provided another electron gun for a color cathode ray tube comprising: a triode including a cathode, a control electrode, and a screen electrode for producing electron beams; and first, second, third, fourth, and fifth focus electrodes and a final accelerating electrode sequentially disposed from the screen electrode, wherein a first constant voltage is applied to the first, third, and fifth focus electrodes, a second constant voltage lower than the first constant voltage is applied to the screen electrode and the second focus electrode, and a third constant voltage lower than the first constant voltage and different from the second constant voltage is applied to the fourth focus electrode, so that a first auxiliary lens section for crossing electron beams from the triode is formed by the first, second, and third focus electrodes, a second auxiliary lens for pre-focusing the crossed electron beams is formed by the third, fourth, and fifth focus electrodes, and a main lens is formed by the fifth focus and final acceleration electrodes.

BRIEF DESCRIPTION OF THE DRAWINGS

The above objects and advantages of the present invention will become more apparent by describing in detail preferred embodiments with reference to the attached drawings in which.

DETAILED DESCRIPTION OF THE INVENTION

Figure 1:
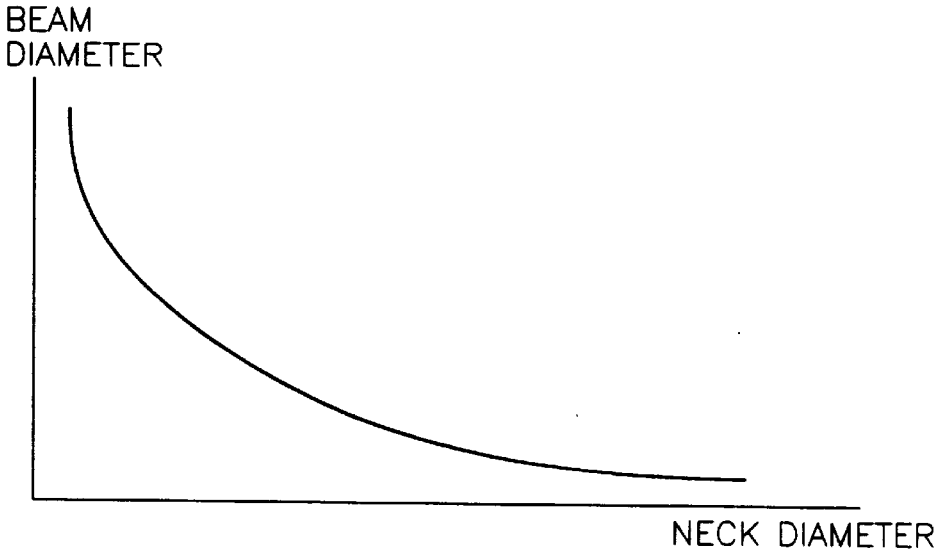
FIG. 1 is a graph showing the relationship between electron beam diameter and CRT neck diameter.
Figure 2:
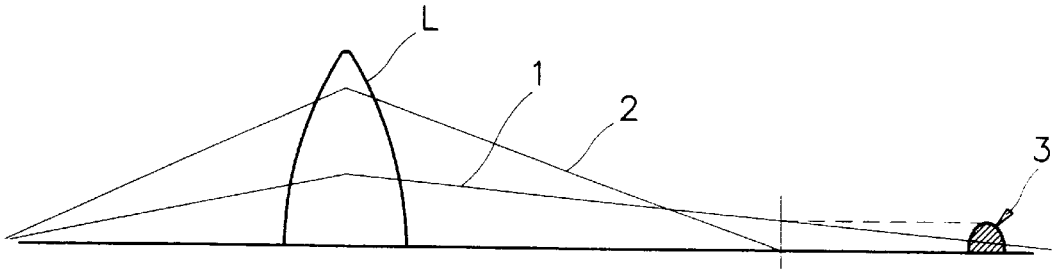
FIG. 2(PRIOR ART)
FIG. 2 schematically illustrates electron beams focused by a conventional electron lens.
Figure 3:
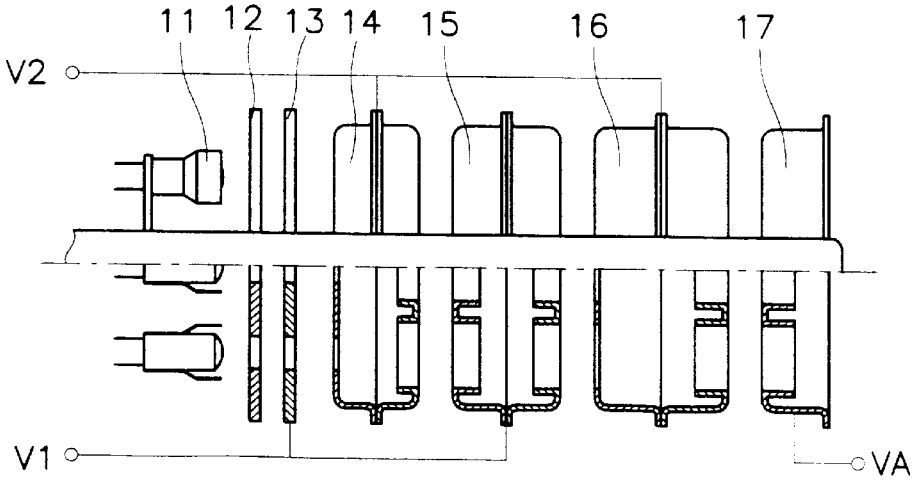
FIG. 3 is a partially sectioned side view showing an embodiment of an electron gun for a color cathode ray tube according to the present invention.

An electron gun for a color CRT according to the present invention is housed in the neck section of the CRT and emits electrons for illuminating a fluorescent film on the screen of the CRT. As shown in FIG. 3, the electron gun for the color CRT according to the present invention includes a cathode 11, a control electrode 12, and a screen electrode 13, forming a triode, first, second, and third focus electrodes 14, 15, and 16, forming an auxiliary lens as a unipotential electron lens or a bipotential electron lens, and a final accelerating electrode 17 adjacent to the third focus electrode 16 forming a main lens section.

A first constant voltage V1 is applied to the screen electrode 13 and the second focus electrode 15, a second constant voltage V2, higher than the first constant voltage V1, is applied to the first focus electrode 14 and the third focus electrode 16. An anode voltage VA is applied to the final accelerating electrode 17. By applying voltages in such a manner, the focusing power of the auxiliary lens 100 formed by the first, second, and third focus electrodes 14, 15, and 16 is larger than that of the main lens 200 formed between the third focus electrode 16 and the final accelerating electrode 17 so that a cross-over point P of the electron beams is formed in front of the main lens 200. The auxiliary lens 100 having such an intensive focusing power is formed by increasing the voltage difference between the respective electrodes forming the auxiliary lens 100 and by making the first and second focus electrodes 14 and 15, which affect the focusing power of the auxiliary lens, longer than in the conventional electron gun.

For example, a voltage of 0 V as the first constant voltage is applied to the screen electrode 13 and the second focus electrode 15, and a voltage of 7 kV as the second constant voltage is applied to the first and third focus electrodes 14 and 16. It is preferable that the length of the first focus electrode 14 be within 2–4 mm, and the length of the third focus electrode 16 be within 10–16 mm. A voltage of 25 kV, as the anode voltage, is applied to the final accelerating electrode 17. When the lengths of the respective electrodes are adjusted as described above, and the voltages are applied to the respective electrodes, a cross-over point is located in front of the main lens, i.e., between the auxiliary lens 100 and the main lens 200.

Figure 4:
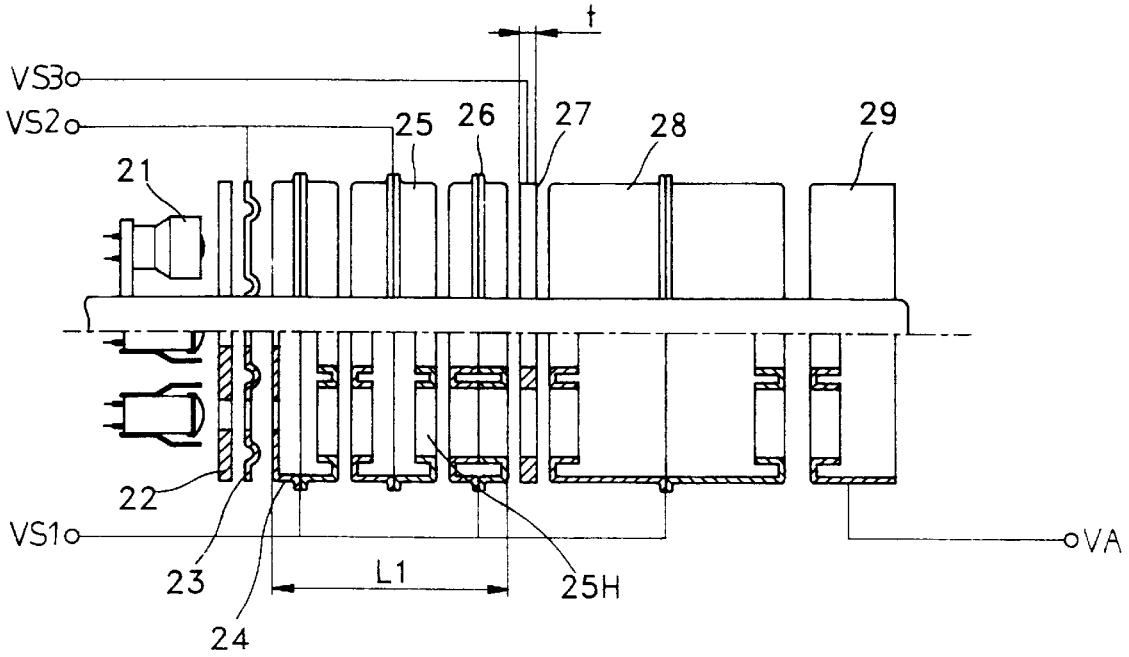
FIGS. 4 and 5 are partially sectioned side views showing other embodiments of an electron gun for a color cathode ray tube according to the present invention.

Another embodiment of the electron gun according to the present invention is shown in FIG. 4. As shown, the electron gun includes a cathode 21, a control electrode 22, and a screen electrode 23, forming a triode, first through fifth focus electrodes 24 through 28 for forming an auxiliary lens section including a plurality of unipotential electron lenses or bipotential electron lenses, and a final accelerating electrode 29 disposed adjacent to the focus electrode 28 for forming a main lens. Voltages are applied to the respective electrodes. An anode voltage VA of 25–35 kV is applied to the final accelerating electrode 29, a first constant voltage VS1 that is 25–35% of the anode voltage VA, is applied to the first, third, and fifth focus electrodes 24, 26, and 28, a second constant voltage VS2 of 0 V, lower than the first constant voltage VS1, is applied to the screen electrode 23 and the second focus electrode 25. A third constant voltage VS3 of 400–800 V is applied to the fourth focus electrode 27.

It is preferable that the length L1 between the first and third focus electrodes 24 and 26 forming the auxiliary lens be three to five times the diameter of the electron beam passing hole 25H of the focus electrode 25 positioned between the focus electrodes 24 and 26. It is preferable that the thickness (t) of focus electrode 27 of the second auxiliary lens be 0.1 to 0.5 times the diameter of the electron beam passing hole 25H of the focus electrode 25.

According to the experiments of the present inventors, when the electron beam passing hole 25H of the focus electrode 25 has a diameter of 3.9 mm, the trails of the electron beams cross in front of the main lens when a voltage of 0–800 V is applied not only to the control electrode 22 and the screen electrode 23 but also to the second focus electrode 25, centrally disposed between the three focus electrodes 24, 25, and 26, and the fourth focus electrode 27. The length of the first focus electrode 24 is 2.0–3.0 mm, the length of the second focus electrode 25 is 3.0–5.0 mm, the length of the third focus electrode 26 is 3.0–5.0 mm, the thickness of the fourth focus electrode 27 is 0.4–2.0 mm, and the length of the focus electrode 28 is 10–16 mm.

Figure 5:
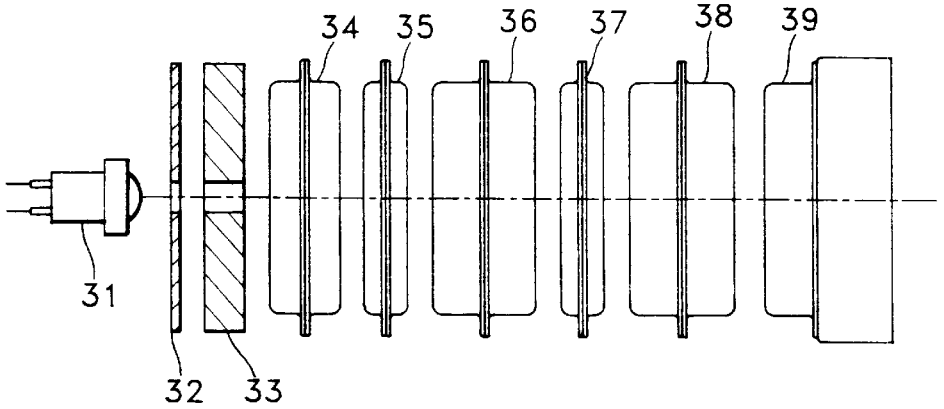
Figure 7:
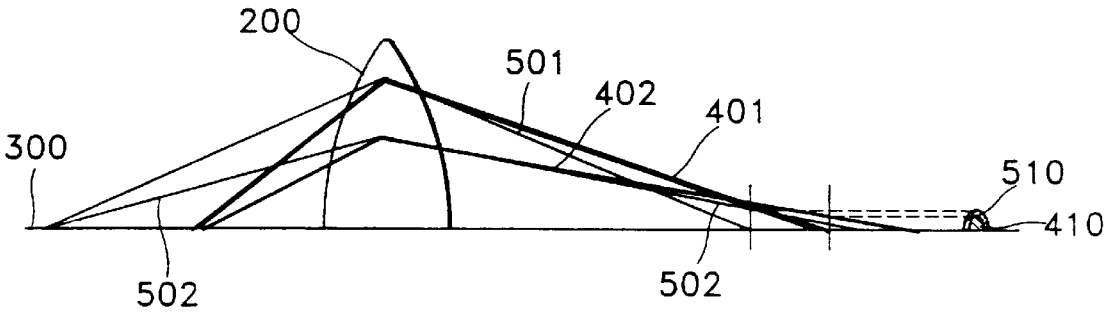
FIG. 7 is a diagram visualizing electron beams passing through a conventional main lens and a main lens according to the present invention.

Still other embodiments of the electron gun according to the present invention are shown in FIGS. 5 and 7. The electron gun of FIG. 5 includes a cathode 31, a control electrode 32, and a screen electrode 33, forming a triode, first, second, and third focus electrodes 34, 35 and 36 forming a first auxiliary lens, i.e., a unipotential electron lens or a bipotential electron lens, fourth and fifth focus electrodes 37 and 38 disposed adjacent to the third focus electrode 36 for forming a second auxiliary lens, and a final accelerating electrode 39 disposed adjacent to the fifth focus electrode 38 for forming a main lens. Voltages having large potential differences are applied to the respective focus electrodes 34, 35, and 36, respectively so that a cross-over point P of the electron beams emitted from the cathode 31 of the triode is located between the first and second auxiliary lenses.

Figure 6:
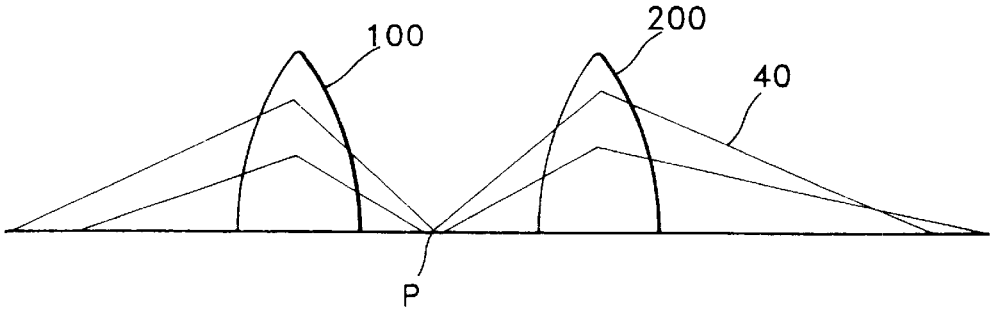
FIGS. 6, 8, and 9 each are views of the trails of electron beams formed by the electron guns according to the present invention and shown in FIGS. 3, 4, and 5, respectively.

Voltages are applied to respective electrodes of the electron gun for the color CRT according to the present invention shown in FIG. 3. A first constant voltage V1 is applied to the screen electrode 13 and the second focus electrode 15, a second constant voltage V2 is applied to the first and third focus electrodes 14 and 16, and an anode voltage VA is applied to the final accelerating electrode 17, an auxiliary lens 100 is formed between the first, second, and third focus electrodes 14, 15, and 16, and a main lens 200 is formed by the third focus electrode 16 and the final accelerating electrode 17, as shown in FIG. 6.

Therefore, the electron beams emitted from the cathode 11 are pre-focused and accelerated by the auxiliary lens 100, are finally focused and accelerated by the main lens 200, and then land on the fluorescent film. Since the focusing power of the auxiliary lens 100 is stronger than that of the main lens 200, the electron beams passing through the auxiliary lens 100 cross at a point (a cross-over point P) in front of the main lens 200 and then are incident on the main lens 200, thereby increasing the difference between the angles of incidence on the main lens 200, reducing the spherical aberration produced by the main lens 200.

This feature will now be described in more detail. FIGS. 6 and 7 show the trails of the electron beams passing through the main lens 200. If electron beams pass through the peripheral portion of the electron lens, the focusing power is relatively large, which increases spherical aberration components. Since the cross-over point P of an electron beam 401 (indicated by thick solid lines in FIG. 7) in the electron gun according to the present invention is positioned between the auxiliary lens 100 and the main lens 200, the angle of incidence of the electron beam 401 passing through the peripheral portion of the main lens section 200 becomes relatively large. Therefore, in view of the trails of the electron beams, the focal length of the electron beam 401 becomes larger than that of the conventional electron beam 501 (indicated by a solid line in FIG. 7).

An electron beam 402 incident from the cross-over point P on the central portion of the main lens section 200, has an angle of incidence smaller than that of electron beam 401 passing through the peripheral portion of main lens 200. Therefore, the change in the focal lengths of electron beams passing through the central portion of the main lens 200, i.e., the change from the focal length of the electron beam 502 to that of the electron beam 402, is smaller than that of electron beams passing through the peripheral portion of the main lens 200, i.e., the change from the focal length of electron beam 501 to that of the electron beam 401.

Figure 10:
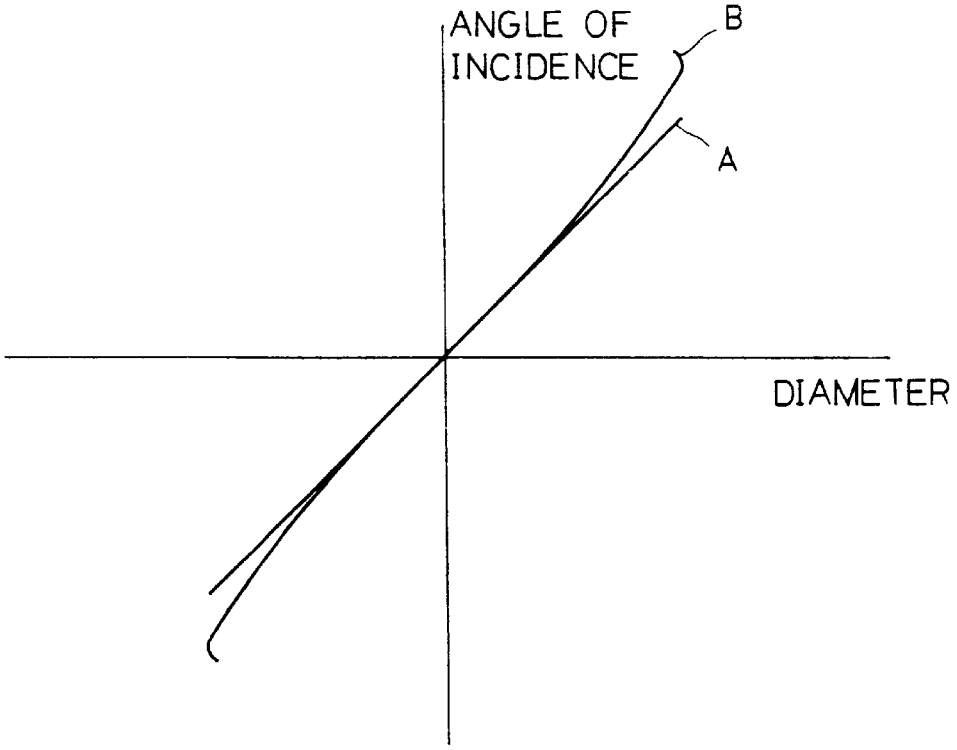
FIG. 10 is a view showing the change in angles of incidence at the front of the main lens for the conventional electron gun and/or an electron gun according to the present invention.

The entire distribution of the change in angles of incidence described above is shown in FIG. 10. As shown, the change in angles of incidence of electron beams passing through the peripheral portion, indicated by a line B, is relatively large, and the change in angles of incidence of electron beams passing through the central portion, indicated by a line A, is relatively small.

Since the electron beam 402 which is incident from the cross-over point P on the central portion of the main lens 200 has a relatively small angle of incidence on the main lens 200, its focal length is longer than that of the conventional electron beam 502. Therefore, as shown in FIG. 7, the area of an electron beam spot 410 focused on the fluorescent film can be made smaller than that of a conventional electron beam spot 510.

Figure 8:
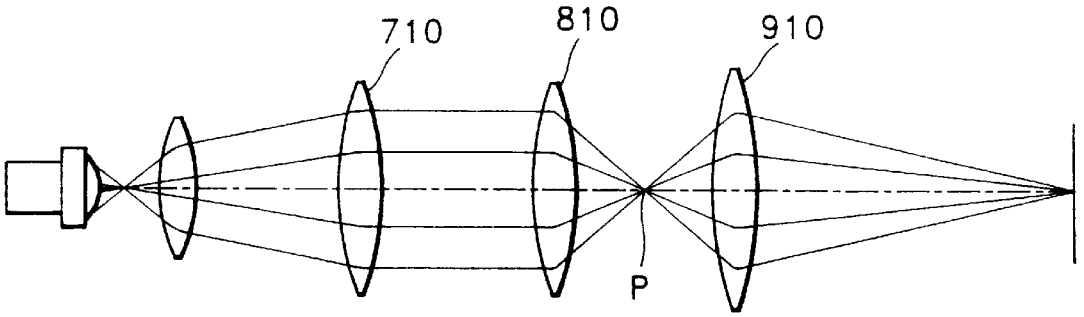

In the electron gun shown in FIG. 4, electron beams pass through first and second auxiliary lenses 710 and 810, and a main lens 910, respectively formed by applying the first constant voltage VS1 to the first, third, and fifth focus electrodes 24, 26, and 28 and the second and third constant voltages VS2 and VS3, second constant voltage VS2 being lower than the first constant voltage VS1, to the second and fourth focus electrodes 25 and 27, and applying an anode voltage VA to the final accelerating electrode 29. The electron beams cross in front of the main lens 910, between the second auxiliary lens 810 and the main lens 910, as shown in FIG. 8. The focusing operation of such electron beams crossing in front of the main lens 910 and passing through that main lens has been described above.

Figure 9:
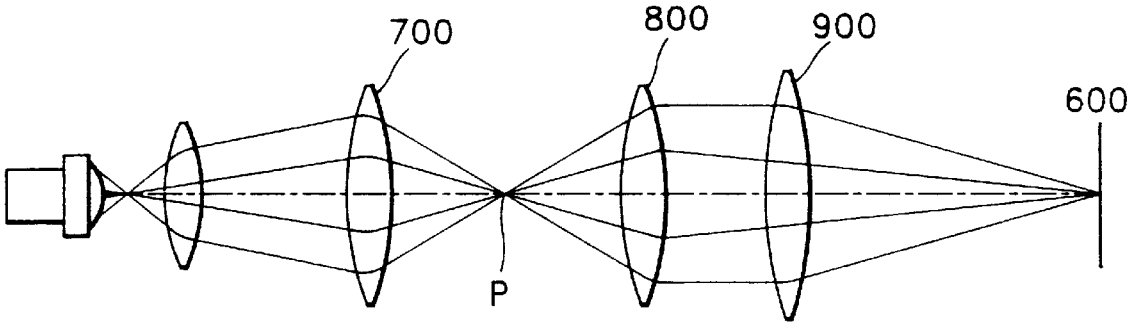

Since voltages are applied to the respective electrodes of the electron gun for the color CRT according to the present invention, as shown in FIGS. 5 and 9, first and second auxiliary lenses 700 and 800 are formed by first, second, and third focus electrodes 34, 35, and 36, and third, fourth, and fifth focus electrodes 36, 37, and 38, respectively, and a main lens 900 is formed by the fifth focus electrode 38 and a final accelerating electrode 39. The electron beams emitted from cathode 11 are pre-focused and accelerated by the first auxiliary lens section 700, cross, are re-focused and accelerated by the second auxiliary lens 800, and are finally focused and accelerated by the main lens 900 to land on a fluorescent film 600 of a screen.

During this process, the focusing power of the first auxiliary lens 700 is relatively stronger than those of the other lenses. Thus, since the electron beams passing through the first auxiliary lens 700 cross before reaching the second auxiliary lens 800, the electron beam spot on the screen can be reduced in area as described above. However, due to a deflection yoke, the larger the diameter of the electron beam passing through the main lens, the poorer the state of the electron beam spot landing on the peripheral portion of the screen. Therefore, using the second auxiliary lens, the radius of electron beams incident on the main lens can be reduced, thereby improving the resolution of the entire screen.

In the electron gun according to the present invention, even if the electron gun is relatively small, that is, the effective diameter is decreased in size by 15–20% as compared with the normal electron gun, the same size electron beam spot can be produced at a low current.

As described above, the electron gun for a color CRT according to the present invention improves focus characteristics by reducing the spherical aberration of a main lens, thereby reducing the area of electron beam spot. The electron gun for the color CRT according to the present invention is not limited to the embodiments described and various changes and modifications may be effected by one skilled in the art within the scope and spirit of the invention as defined in the appended claims.

What is claimed is:

1. An electron gun for a color cathode ray tube comprising:

a triode including a cathode, a control electrode, and a screen electrode for producing electron beams; and first, second, and third focus electrodes and a final accelerating electrode sequentially disposed from said screen electrode, wherein a first constant voltage is applied to said screen electrode and said second focus electrode, a second constant voltage higher than the first constant voltage is applied to said first focus electrode and said third focus electrode, and an anode voltage higher than the second constant voltage is applied to said final accelerating electrode, so each electron beam from said triode crosses between a main lens formed by said third focus electrode and said final accelerating electrode, and an auxiliary lens formed by said first, second, and third focus electrodes.

2. The electron gun as claimed in claim 1, wherein the electron beams passing through said auxiliary lens cross at a point.

3. An electron gun for a color cathode ray tube comprising:

a triode including a cathode, a control electrode, and a screen electrode for producing electron beams; and first, second, third, fourth, and fifth focus electrodes and a final accelerating electrode sequentially disposed from said screen electrode, wherein a first constant voltage is applied to said first, third, and fifth focus electrodes, a second constant voltage lower than the first constant voltage is applied to said screen electrode and said second focus electrode, and a third constant voltage lower than said first constant voltage and different from the second constant voltage is applied to said fourth focus electrode, so that a first auxiliary lens section for crossing electron beams from said triode is formed by said first, second, and third focus electrodes, a second auxiliary lens for pre-focusing the crossed electron beams is formed by said third, fourth, and fifth focus electrodes, and a main lens is formed by said fifth focus and final acceleration electrodes.

4. The electron gun as claimed in claim 1, wherein the electron beams passing through said first and second auxiliary lenses cross at a point.

5. The electron gun as claimed in claim 3, wherein the electron beams cross at a point determined by said first auxiliary lens.

6. The electron gun as claimed in claim 3, wherein the electron beams cross between said second auxiliary lens and said main lens.

7. The electron gun as claimed in claim 3, wherein the second focus electrode has electron beam passing holes having a diameter, and a distance from the first focus electrode at a side facing the triode to the third focus electrode at a side facing the fourth focus electrode is three to five times the diameter of the beam passing holes in the second focus electrode.

8. The electron gun of claim 3, wherein the second focus electrode has electron beams passing holes having a diameter and the fourth focus electrode has a thickness 0.1 to 0.5 times the diameter of the beam passing holes in the second focus electrode.

9. The electron gun as claimed in claim 3, wherein the second focus electrode has electron beam passing holes having a diameter, a distance from the first focus electrode at a side facing the triode to the third focus electrode at a side facing the fourth focus electrode is three to five times the diameter of the electron beam passing holes in the second focus electrode, and the fourth focus electrode has a thickness 0.1 to 0.5 times the diameter of the electron beam passing holes in the second focus electrode.

10. The electron gun as claimed in claim 3, wherein the third constant voltage is higher than the second constant voltage.

11. The electron gun as claimed in claim 3, wherein the third constant voltage is lower than the second constant voltage.

* * * * *